US011691186B2

(12) United States Patent
Linton et al.

(10) Patent No.: US 11,691,186 B2
(45) Date of Patent: Jul. 4, 2023

(54) SPRAY APPLICATOR APPARATUSES FOR GENERATING UNIFORM SPRAY PATTERNS AND METHODS INCORPORATING THE SAME

(71) Applicant: Toyota Motor Engineering & Manufacturing North America, Inc., Plano, TX (US)

(72) Inventors: Wayne M. Linton, Floresville, TX (US); Adan Gonzalez, Jourdanton, TX (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 785 days.

(21) Appl. No.: 16/527,843

(22) Filed: Jul. 31, 2019

(65) Prior Publication Data

US 2021/0031242 A1 Feb. 4, 2021

(51) Int. Cl.

| | |
|---|---|
| ***B05B 12/22*** | (2018.01) |
| ***B05B 12/34*** | (2018.01) |
| ***B08B 3/02*** | (2006.01) |
| ***B05D 1/02*** | (2006.01) |

(52) U.S. Cl.

CPC ..... *B08B 3/02* (2013.01); *B05B 12/22* (2018.02); *B05B 12/34* (2018.02); *B05D 1/02* (2013.01)

(58) Field of Classification Search

CPC ..... B05B 12/20–36

See application file for complete search history.

(56) References Cited

U.S. PATENT DOCUMENTS

| | | | | | |
|---|---|---|---|---|---|
| 4,239,016 | A * | 12/1980 | Cathers | B05B 14/465 118/631 |
| 4,974,532 | A * | 12/1990 | March | B05B 12/22 118/301 |
| 8,455,054 | B2 * | 6/2013 | Brewer | B05B 16/40 427/427.2 |
| 2017/0354985 | A1 * | 12/2017 | Jimenez Ramos | B05C 5/0216 |

FOREIGN PATENT DOCUMENTS

| | | | | |
|---|---|---|---|---|
| CN | 102974492 | B | 9/2015 | |
| CN | 206104167 | U | 4/2017 | |
| CN | 106238247 | B | 9/2018 | |
| DE | 3712422 | * | 8/1988 | C23C 22/73 |
| DE | 102004034021 | B4 | 6/2008 | |
| KR | 101313820 | B1 | 9/2013 | |

* cited by examiner

*Primary Examiner* — Yewebdar T Tadesse
*Assistant Examiner* — Stephen A Kitt
(74) *Attorney, Agent, or Firm* — Dinsmore & Shohl LLP

(57) ABSTRACT

A spray apparatus that includes a stand, a motor secured to the stand, a spray applicator secured to the stand, and a rotatable disc secured to the stand relatively above the spray applicator such that the rotatable disc is positioned within a spray field of the spray applicator. The rotatable disc is coupled to the motor such that the rotatable disc is configured to rotate in response to activation of the motor. The rotatable disc is configured to receive an overspray from the spray field to generate a spray pattern from the spray applicator. The apparatus includes a scraper positioned in fixed engagement with the rotatable disc, where the scraper is configured to remove accumulated overspray from the rotatable disc.

16 Claims, 5 Drawing Sheets

SPRAY APPLICATOR APPARATUSES FOR GENERATING UNIFORM SPRAY PATTERNS AND METHODS INCORPORATING THE SAME

TECHNICAL FIELD

The present specification generally relates to spray applicator apparatuses for dispensing a material, and more particularly, spray applicator apparatuses that generate a uniform spray pattern along a target object.

BACKGROUND

Manufacturing of certain objects generally includes a painting process in which layers of paint and/or other materials are dispensed over an exterior surface of the manufactured object. Generally, such painting processes are automated utilizing autonomous manufacturing systems along an assembly line, such as robotic devices, that include spray applicators to dispense said material onto the manufactured object. However, such systems and equipment may periodically experience failures that thereby require a supplementary system, such as a manual system, to conduct said painting process to complete the manufacture of the object. Dispensing a material manually in lieu of an automated process may be subject to further errors that result in increased assembly time, labor, and costs. For example, is may be difficult for manual systems to apply a material to an exterior surface of an object with a uniform spray pattern similar to that generated by autonomous manufacturing systems.

Accordingly, a need exists for spray applicator apparatuses for dispensing a material onto a target object that are capable of generating a uniform spray pattern.

SUMMARY

In one embodiment, a spray apparatus comprises a stand, a motor secured to the stand, a spray applicator secured to the stand, and a rotatable disc secured to the stand relatively above the spray applicator such that the rotatable disc is positioned within a spray field of the spray applicator. The rotatable disc is coupled to the motor such that the rotatable disc is configured to rotate in response to activation of the motor. The rotatable disc is configured to receive an overspray of the spray field to generate a spray pattern from the spray applicator. The apparatus includes a scraper positioned in fixed engagement with the rotatable disc, where the scraper is configured to remove accumulated overspray from the rotatable disc.

In another embodiment, a pneumatic painting assembly comprises a modular stand that is configured to selectively translate, a pneumatic motor secured to the modular stand such that a position of the pneumatic motor is selectively adjustable on the modular stand, and a material applicator secured to the modular stand such that a position of the material applicator is selectively adjustable on the modular stand. The pneumatic painting assembly comprises a disc secured to the modular stand relatively above the material applicator such that the disc is partially positioned within a spray field of the material applicator. The disc is coupled to the pneumatic motor such that the disc is configured to rotate in response to activation of the pneumatic motor. The pneumatic painting assembly comprises a scraper positioned in continuous engagement with the rotatable disc. The disc is configured to catch a portion of material from the material applicator to generate a spray pattern from the material applicator, and the scraper is configured to remove material caught by the rotatable disc from the material applicator.

In another embodiment, a method of dispensing a material from a spray assembly comprises actuating a spray applicator to dispense the material therefrom and receiving at least a portion of the material dispensed from the spray applicator at a rotatable disc thereby generating a spray pattern from the spray applicator to a target object. The method comprises removing the portion of the material received along the rotatable disc by a scraper positioned in engagement with the rotatable disc. The scraper is fixedly secured to the rotatable disc such that the scraper is in continuous contact with the rotatable disc as the rotatable disc rotates.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Spray apparatuses and/or pneumatic painting assemblies are disclosed herein. In one embodiment, a spray apparatus includes a stand and a motor secured to the stand, with the stand being modular such that a configuration of the stand is selectively adjustable. The spray apparatus further includes a spray applicator secured to the stand, and a rotatable disc secured to the stand relatively above the spray applicator. In this instance, the rotatable disc is positioned within a spray field of the spray applicator. The rotatable disc is coupled to the motor such that the rotatable disc is configured to rotate in response to activation of the motor. The rotatable disc is configured to receive an overspray from the spray applicator to generate a spray pattern from the spray applicator. In particular, the rotatable disc is operable to generate a uniform spray pattern in response to receiving at least a portion of the spray field from the spray application (i.e. an overspray) as the spray applicator releases material therefrom. The spray apparatus further includes a scraper positioned in fixed engagement with the rotatable disc that is configured to remove accumulated material from the rotatable disc in response to the rotatable disc receiving the overspray.

As used herein, the terms "above" and "below" are used to describe the relative positioning of various components of the spray apparatus. Because the apparatus may be generally symmetrical about an apparatus centerline, the terms "above" and "below" may be switched when evaluating components positioned along opposite sides of the spray apparatus. Further, while certain components of the apparatus are described as extending or oriented toward one of the various components of the spray apparatus, it should be understood that these components extend or are oriented in at least these recited directions. While the embodiments of the present disclosure are described and depicted herein in reference to a single apparatus structure, it should be understood that apparatuses that are constructed with a segmented construction may incorporate the elements that are shown and described herein.

Figure 1:
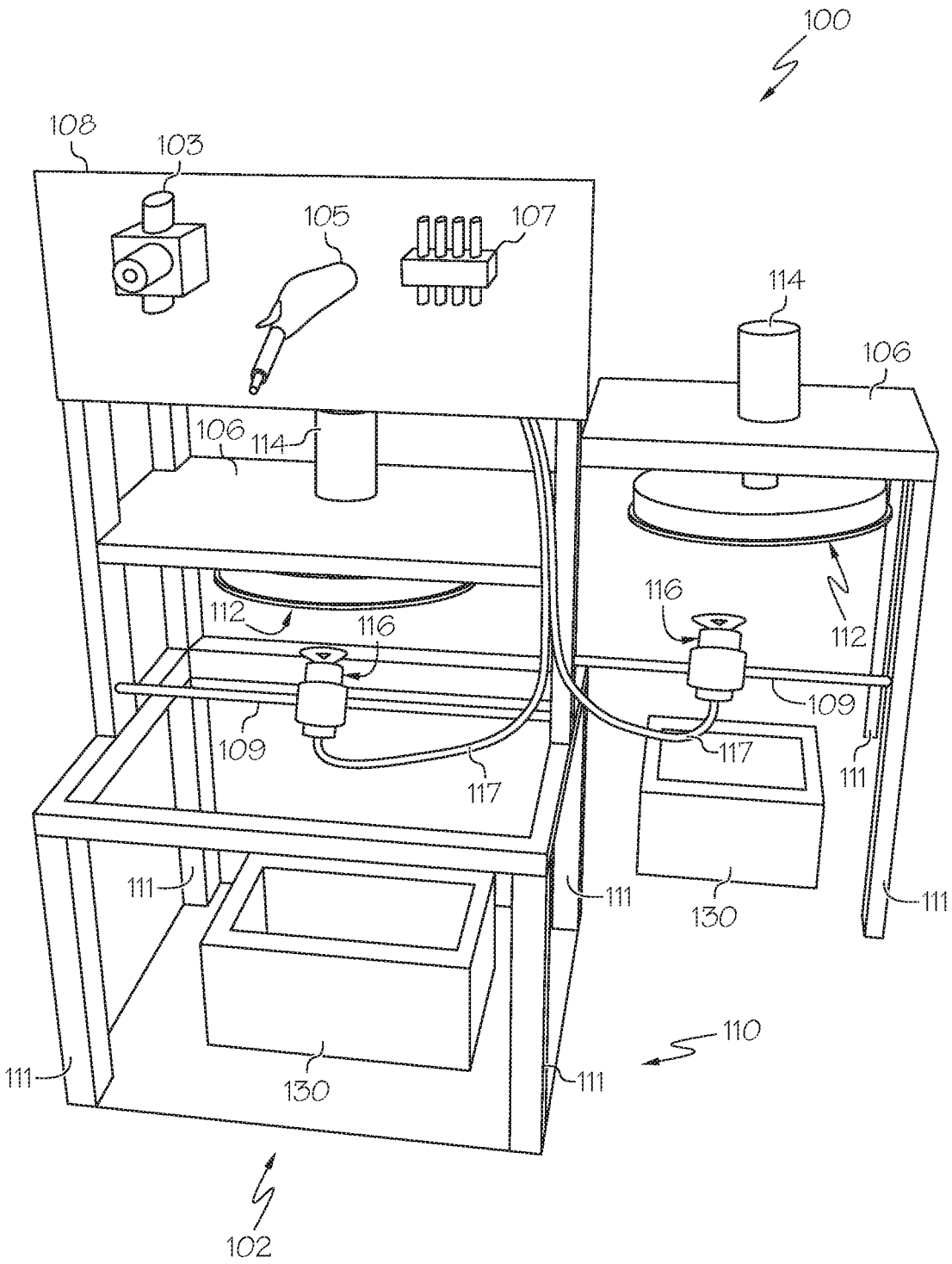
FIG. 1 schematically depicts a perspective view of a spray apparatus including a spray applicator and a rotatable disc according to one or more embodiments shown or described herein.

Referring to FIG. 1, an illustrative schematic view of a spray apparatus 100 is depicted. The spray apparatus 100 comprises a modular stand assembly 110 including a plurality of modular legs 111 for supporting one or more components of the spray apparatus 100. The plurality of modular legs 111 are selectively adjustable such that a size, shape and/or configuration of the modular stand assembly 110 may be modified and a relative position of the one or more components supported by the modular stand assembly 110 are movable relative one another. In other words, the modular stand assembly 110 includes one more devices and/or platforms secured thereto such that relative heights of the devices and/or platforms are customizable in response to an adjustment of the modular legs 111. For example, in some embodiments the plurality of modular legs 111 is configured to selectively translate to increase and/or decrease a relative height of the modular stand assembly 110. As will be described in greater detail herein, a height of the modular stand assembly 110 may be adjusted dependent on the size of a target object to be sprayed by the spray apparatus 100. It should be understood that the modular stand assembly 110 may include various suitable mechanisms for selectively transitioning a height and/or lateral position of the one or more devices included thereon via the plurality of modular legs 111.

The modular stand assembly 110 includes a user interface side 102 and an object interface side 104 (See FIG. 2) that is positioned along opposing ends of the modular stand assembly 110. As described in greater detail herein, the user interface side 102 of the modular stand assembly 110 is positioned within an environment adjacent to a location of an operator (not shown) of the spray apparatus 100 and the object interface side 104 is positioned adjacent to a location of a target object (not shown) to be sprayed by the spray apparatus 100. In the present example, the modular stand assembly 110 includes one or more platforms 106 that are sized and shaped to securely support one or more devices of the spray apparatus 100 thereon. In embodiments, the spray apparatus 100 includes one or more rotatable discs 112 positioned along the modular stand assembly 110, and in particular the one or more rotatable discs 112 are rotatably coupled to a bottom surface of the one or more platforms 106. The spray apparatus 100 further includes one or more motors 114 secured to the modular stand assembly 110 at the one or more platforms 106, and more specifically at a top surface of the one or more platforms 106 opposite of the rotatable discs 112. The one or more motors 114 are coupled to the one or more rotatable discs 112 through the platform 106. In particular, each rotatable disc 112 positioned on the modular stand assembly 110 includes at least one motor 114 coupled thereto. The one or more motors 114 of the spray apparatus 100 are configured to selectively rotate the one or more rotatable discs 112 in response to an activation of the motors 114, respectively.

Still referring to FIG. 1, in the present example the modular stand assembly 110 includes a pair of platforms 106 with each platform 106 including at least one rotatable disc 112 secured thereto and at least one motor 114 positioned thereon. It should be understood that in other embodiments the locations of the rotatable discs 112 and the motors 114 relative to the platforms 106 and/or the modular stand assembly 110 may vary without departing from the scope of the present disclosure. In some embodiments, the platforms 106 may be omitted entirely and/or have varying sizes, shapes and/or configurations relative to the modular stand assembly 110. In other embodiments, additional and/or fewer platforms 106, rotatable discs 112 and/or motors 114 may be included along the modular stand assembly 110 of the spray apparatus 100 than those shown and described herein. The one or more motors 114 of the spray apparatus 100 may comprise various suitable drive mechanisms configured to actuate the rotatable disc 112 coupled thereto, such as, for example, a pneumatic rotary actuator.

The modular stand assembly 110 further includes one or more elongated arms 109 secured thereto. In the present example, the one or more elongated arms 109 extend between and are coupled to a pair of modular legs 111 of the modular stand assembly 110. Each of the elongated arms 109 included on the modular stand assembly 110 is positioned relatively below a corresponding platform 106 of the modular stand assembly 110. As will be described in greater detail herein, the one or more elongated arms 109 are configured to support a component of the spray apparatus 100 thereon, such as, for example, a spray applicator 116. The spray apparatus 100 further includes one or more spray applicators 116 secured to the modular stand assembly 110. In particular, the one or more spray applicators 116 are movably coupled to the elongated arms 109 of the modular stand assembly 110 such that the spray applicators 116 are pivotable, rotatable, and/or movable along the elongated arms 109. The one or more spray applicators 116 are movable independent of a selective adjustment of the modular legs 111 of the modular stand assembly 110 and independently movable relative to one another. It should be understood that the spray apparatus 100 includes at least one spray applicator 116 for each rotatable disc 112 and motor 114 positioned on the modular stand assembly 110.

Still referring to FIG. 1, in the present example with the spray applicator 116 secured to the elongated arm 109 and each of the elongated arms 109 secured to the modular stand assembly 110 relatively below the platform 106, the spray applicator 116 is effectively positioned relatively below the rotatable disc 112. As described in greater detail herein, with the rotatable disc 112 secured to the modular stand assembly 110 relatively above the spray applicator 116, the rotatable disc 112 is positioned at least partially within a spray field 101 of the spray applicator 116 (See FIG. 4) during use of the spray apparatus 100. Further, with the spray applicator 116 secured to the elongated arm 109 and the elongated arm 109 coupled to a pair of modular legs 111, a relative height of the spray applicator 116 is selectively adjustable based on a translation of the pair of modular legs 111.

Each of the one or more spray applicators 116 on the modular stand assembly 110 is fluidly coupled to a material reservoir (not shown) via one or more conduits 117 fluidly coupled thereto. In the present example, the modular stand assembly 110 includes a pair of spray applicators 116 positioned relatively below the pair of rotatable discs 112, respectively. As will be described in greater detail herein, the material reservoir may include a material stored therein for receipt and discharge by the spray applicator 116, such as, for example, paint. It should be understood that the one or more conduits 117 may be further coupled to one or more additional reservoirs in lieu of and/or in addition to the material reservoir. The modular stand assembly 110 further includes an interface surface 108 positioned on the user interface side 102 of the spray apparatus 100, with the interface surface 108 including one or more devices of the spray apparatus 100 positioned thereon. Accordingly, with the interface surface 108 facing the user interface side 102 and the one or more devices positioned along the interface surface 108, the one or more devices are located relatively adjacent to an operator of the spray apparatus 100.

Still referring to FIG. 1, in the present example the one or more devices of the spray apparatus 100 includes an air supply control valve 103, a spray actuator 105, and a control valve 107. The air supply control valve 103 of the spray apparatus 100 is configured to selectively control a supply of pressurized air from an air supply (not shown) to each of the one or more spray applicators 116 included on the modular stand assembly 110. In some embodiments, the one or more spray applicators 116 are coupled to the air supply via the one or more conduits 117 coupled thereto, while in other embodiments the modular stand assembly 110 may include additional conduits 117 coupled to the spray applicators 116 for supplying pressurized-air separate from the material supplied thereto from a material reservoir. In some embodiments, the air supply control valve 103 is configured to actively transfer pressurized air from the air supply to only one of the spray applicators 116 of the spray apparatus 100, while in other embodiments the air supply control valve 103 is operable to simultaneously transmit pressurized air to multiple spray applicators 116. The spray actuator 105 of the spray apparatus 100 is configured to actuate the spray applicator 116, and more specifically to activate transmission of pressurized air from the air supply and/or material from the material reservoir to at least one of the spray applicators 116 via the conduits 117. It should be understood that the spray actuator 105 is configured to actuate a particular spray applicator 116 of the spray apparatus 100 that is coupled to the air supply and material reservoir based on a selective actuation of the air supply control valve 103.

The control valve 107 of the spray apparatus 100 is coupled to the motor 114 and configured to selectively adjust a power generated by the motor 114 and transmitted to the rotatable disc 112. For example, in embodiments in which the motor 114 comprises a pneumatic rotary actuator, the control valve 107 is configured to control a rotational speed of the pneumatic rotary actuator thereby adjusting a revolution rate of the rotatable disc 112. The spray apparatus 100 further includes one or more material manifolds 130 disposed within the modular stand assembly 110 and positioned relatively below each of the one or more the rotatable discs 112 included in the spray apparatus 100. In the present example, the modular stand assembly 110 includes a pair of material manifolds 130 positioned underneath the pair of rotatable discs 112 included thereon. Each of the material manifolds 130 are sized and shaped to receive at least a portion of a material, such as, for example, the material transmitted by the spray applicator 116 supplied thereto from the material reservoir (not shown).

Figure 2:
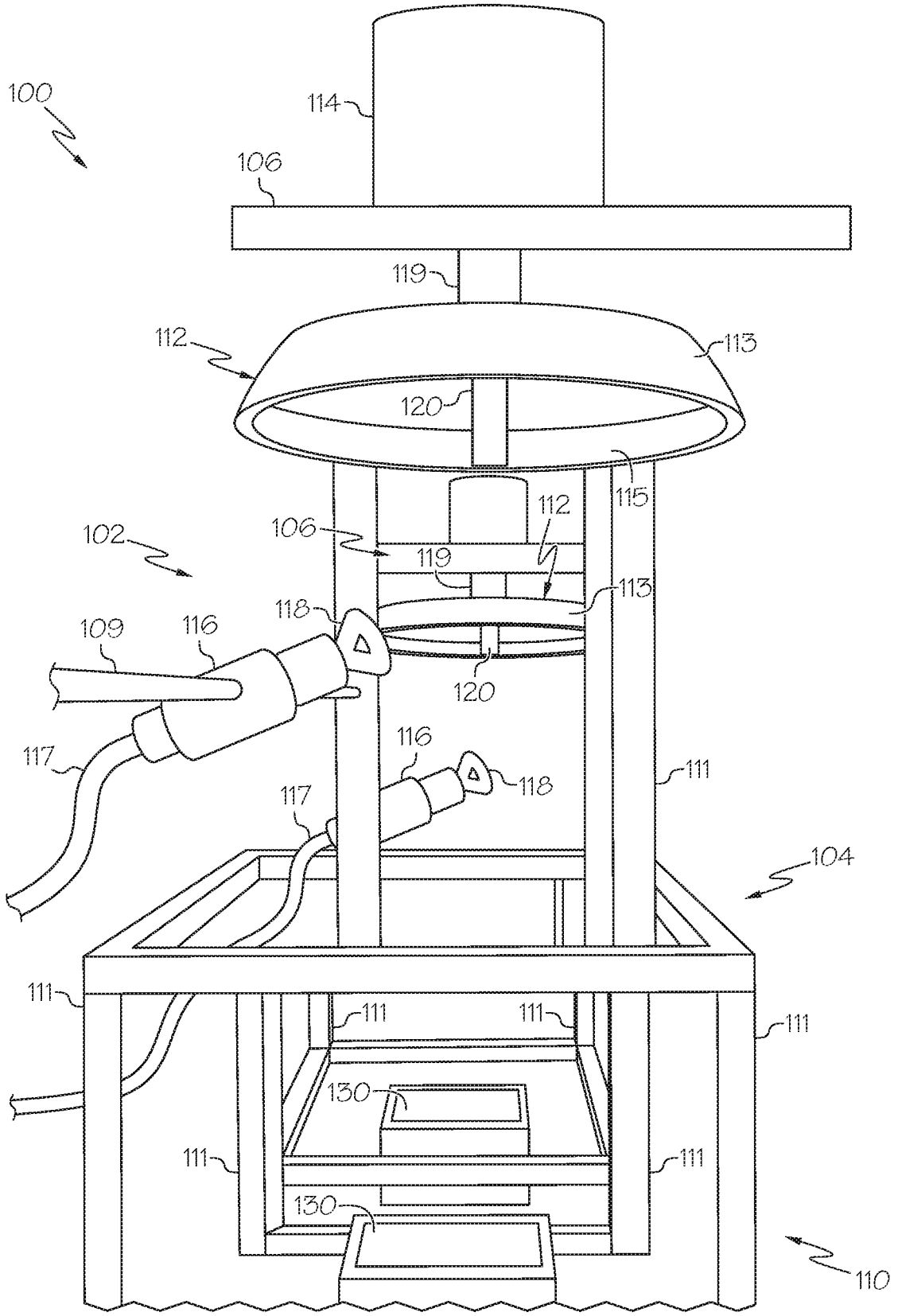
FIG. 2 schematically depicts a side view of the spray apparatus of FIG. 1 with the rotatable disc positioned relatively above the spray applicator according to one or more embodiments shown and described herein.

Referring now to FIG. 2, each of the spray applicators 116 of the spray apparatus 100 includes a discharge head 118 positioned distally relative to the user interface side 102 and proximate to the object interface side 104. In other words, the one or more spray applicators 116 are coupled to the modular stand assembly 110 such that the discharge heads 118 face away from the user interface side 102 and toward the object interface side 104. In this instance, a material transmitted by the spray applicator 116 is discharged from the discharged head 118 toward the object interface side 104 and away from the user interface side 102 of the modular stand assembly 110. It should be understood that a position and/or orientation of the discharge head 118 relative to the object interface side 104 of the modular stand assembly 110 may be selectively adjusted in response to a pivot of the spray applicator 116 about the elongated arm 109 and/or a translation of the pair of modular legs 111 that the elongated arm 109 is coupled to.

Each of the one or more rotatable discs 112 of the spray apparatus 100 includes an exterior surface 113 (i.e. outer ring) disposed about an interior surface 115 (i.e. inner ring) of the rotatable disc 112. The one or more rotatable discs 112 are coupled to the motor 114 via a rotatable shaft 119 extending through the platform 106 and coupled thereto. In particular, the rotatable shaft 119 is coupled to the rotatable disc 112 along the exterior surface 113 and is configured to rotate simultaneously with the rotatable disc 112 in response to an activation of the motor 114. Each of the one or more rotatable discs 112 of the spray apparatus 100 further includes a scraper device 120 disposed within the rotatable disc 112. In particular, the scraper device 120 is coupled to the interior surface 115 of the rotatable disc 112 such that the scraper device 120 is configured to abut against the interior surface 115 as the rotatable disc 112 rotates.

Figure 3:
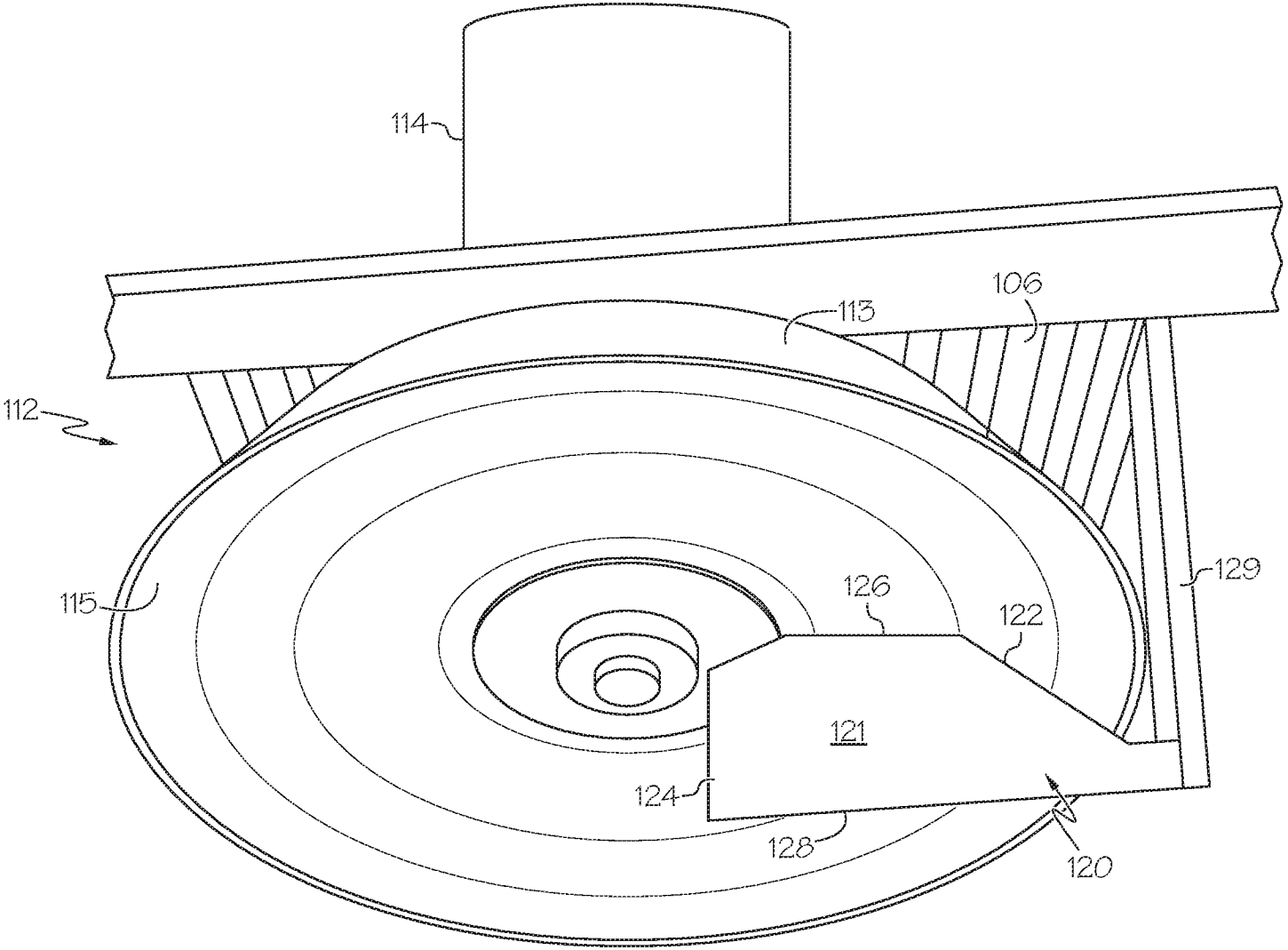
FIG. 3 schematically depicts a perspective view of the rotatable disc of the spray apparatus of FIG. 1 including a scraper device positioned along an interior surface according to one or more embodiments shown and described herein.

Referring to FIG. 3, the scraper device 120 comprises a body 121 that is formed of a flexibly deformable material, such as, for example, an elastic polymer. The body 121 is at least partially defined by an angled wall 122, a vertical wall 124, an upper horizontal wall 126 and a lower horizontal wall 128. The scraper device 120 is secured to the platform 106 by a flange 129 extending therefrom such that a position of the scraper device 120 relative to the interior surface 115 is fixed. As will be described in greater detail herein, with the scraper device 120 secured to the platform 106 via the flange 129 the scraper device 120 maintains a fixed position in response to a rotation of the rotatable disc 112. Specifically, the body 121 of the scraper device 120 is fixedly attached to the flange 129 between the angled wall 122 and the lower horizontal wall 128. It should be understood that in other embodiments the scraper device 120 may be attached to the flange 129 at various other locations and/or walls other than those shown and described herein without departing from the scope of the present disclosure. In some embodiments, the flange 129 may be integrally formed with the body 121 of the scraper device 120 such that the scraper device 120 forms a unitary structure with the flange 129.

The vertical wall 124 of the body 121 defines a height of the scraper device 120 and is positioned opposite of the flange 129. The angled wall 122 and the upper horizontal wall 126 of the body 121 abut against the interior surface 115 such that the scraper device 120 is configured to scrape against the interior surface 115 during a rotation of the rotatable disc 112. At least the angled wall 122 and the upper horizontal wall 126 collectively form an abutment end 122, 126 of the scraper device 120. As will be described in greater detail herein, the abutment end 122, 126 of the scraper device 120 is configured to maintain continuous contact with the interior surface 115 during rotation of the rotatable disc 112. It should be understood that a size, shape and configuration of the body 121 and the walls 122, 124, 126, 128 of the scraper device 120 correspond to a size, shape and configuration of the interior surface 115 of the rotatable disc 112. In other words, the body 121 of the scraper device 120 is sized and shaped to provide a form fit against the interior surface 115 of the rotatable disc 112.

Figure 4:
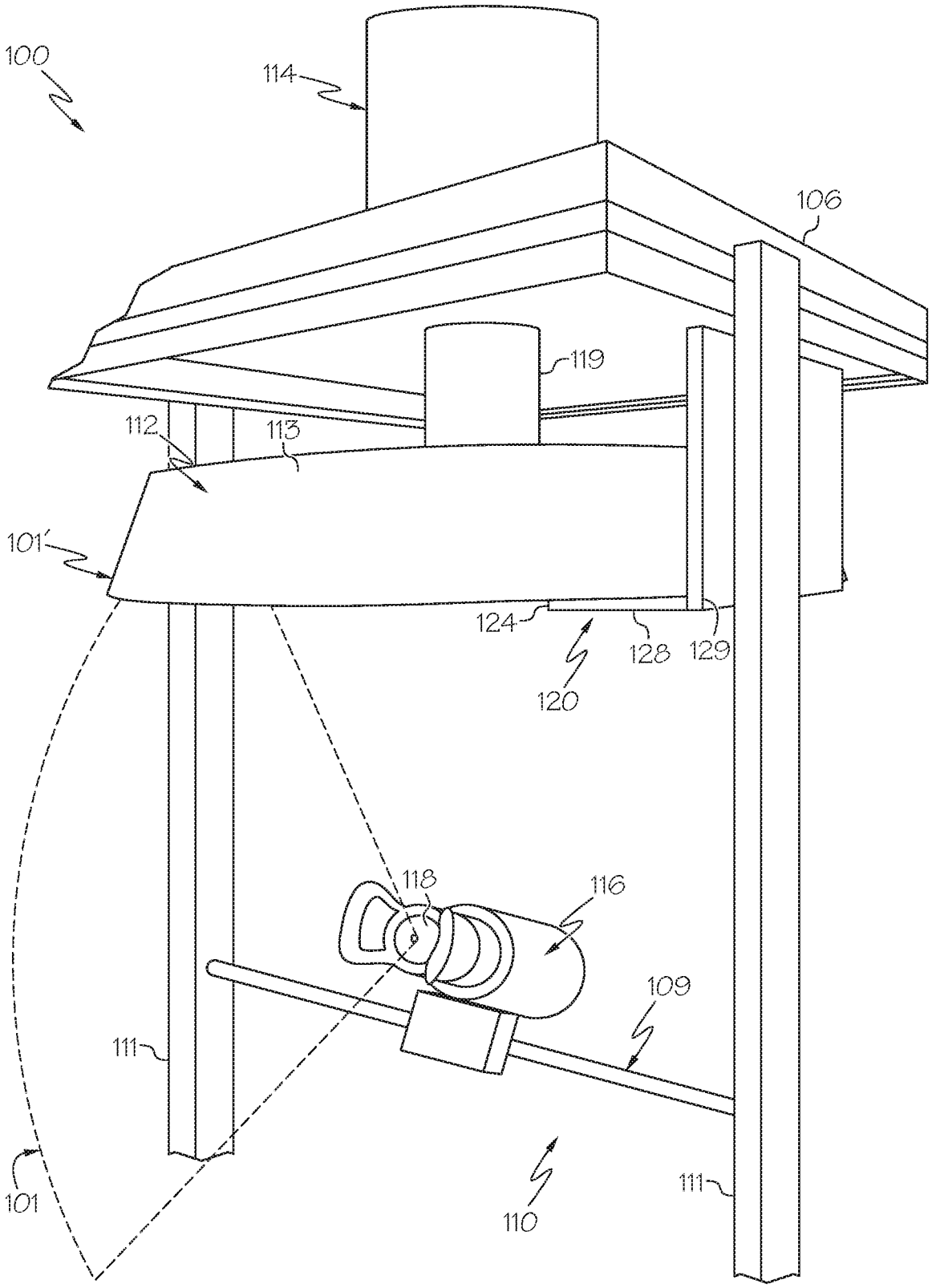
FIG. 4 schematically depicts a perspective view of a spray field of the spray applicator of the spray apparatus of FIG. 1 that intersects with the interior surface of the rotatable disc according to one or more embodiments shown and described herein.
Figure 5:
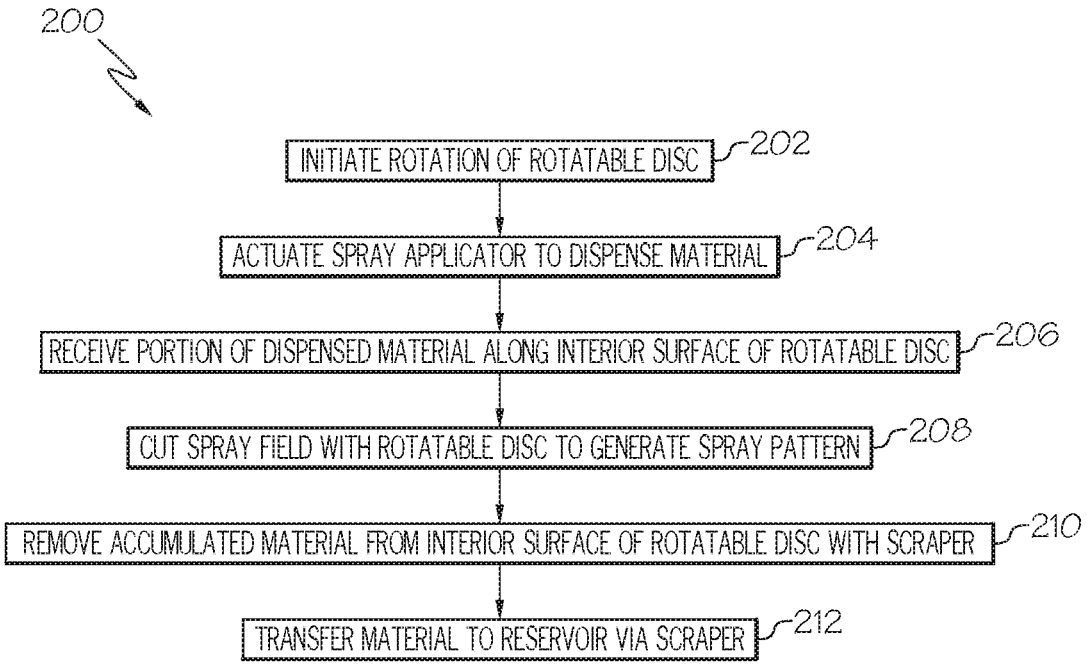
FIG. 5 schematically depicts a flow diagram of an exemplary method of dispensing a material from the spray apparatus of FIG. 1 according to one or more embodiments shown and described herein.

Referring now to FIG. 4 in conjunction with the flow diagram of FIG. 5, an exemplary method 200 of dispensing a material onto a target object utilizing the spray apparatus 100 is schematically depicted. More specifically, the spray apparatus 100 is operable to generate a uniform spray pattern comprising a continuously constant profile of a material (e.g. paint) onto an exterior surface of a target object (e.g., a vehicle). The depiction of FIGS. 4-5 and the accompanying description below is not meant to limit the subject matter described herein or represent an exact description of how a material is evenly discharged onto a target object, but instead is meant to provide a simple schematic overview to illustrate the general production of various spray patterns having an enhanced release output as described herein.

Referring initially to FIG. 2, a target object (not shown) is positioned proximate to the object interface side 104 of the modular stand assembly 110 and an operator of the spray apparatus 100 (not shown) is positioned proximate to the user interface side 102 of the modular stand assembly 110. In this instance, the discharge head 118 of the spray applicator 116 is positioned and directed toward the target object and the interface surface 108 including the air supply control valve 103, the spray actuator 105, and the control valve 107 (See FIG. 1) are positioned toward the operator. In some embodiments, the modular stand assembly 110 of the spray apparatus 100 is positioned adjacent to a conveyor belt (not shown) that receives and translates the target object thereon. In this instance, the target object may comprise a vehicle such that the vehicle gradually moves across the object interface side 104 of the spray apparatus 100 as the conveyor belt translates.

Referring now to FIGS. 1, 4 and 5, at step 202 the motor 114 is initiated in response to an actuation of the control valve 107 along the interface surface 108 of the modular stand assembly 110. In this instance, an operator may selectively adjust a speed of the motor 114, and in particular a rotational speed in instances when the motor 114 comprises a pneumatic rotary actuator, via the control valve 107. With the motor 114 activated and the rotatable disc 112 coupled thereto via the rotatable shaft 119, rotation of the rotatable disc 112 is initiated. In this instance, the rotatable disc 112 is configured to rotate below the platform 106 in accordance with a rotational speed generated by the motor 114. At step 204, the spray actuator 105 of the spray apparatus 100 is actuated by an operator to thereby initiate a material (e.g. paint) transfer from a material reservoir (not shown) to the spray applicator 116. In particular, depending on a selective connection of the spray actuator 105 with at least one of the one or more spray applicators 116 of the spray apparatus 100 via the air supply control valve 103, actuation of the spray actuator 105 initiates transmission of pressurized air from an air supply (not shown) through the one or more conduits 117 coupled to the spray applicator 116. In this instance, with the spray applicator 116 further coupled to a material reservoir via the one or more conduits 117 coupled thereto, the pressurized air effectively transfers material from the material reservoir to the discharge head 118 of the spray applicator 116.

Referring specifically to FIG. 4, material is discharged along a spray field 101 of the discharge head 118 as the spray actuator 105 is actuated by the operator. A position of the spray field 101 relative to the modular stand assembly 110 and/or target object positioned along the object interface side 104 may be selectively adjusted based on a relative height of the spray applicator 116 in accordance with a modification of the one or more modular legs 111. As merely an illustrative example, in some embodiments a height and/or position of the discharge head 118 of the spray applicator 116 is spaced vertically apart from the interior surface 115 of the rotatable disc 112 by about 4 inches. Furthermore, an orientation of the spray field 101 relative to the modular stand assembly 110 and/or target object positioned along the object interface side 104 may be selectively adjusted based on a relative pivot of the spray applicator 116 about the elongated arm 109. As merely an illustrative example, in some embodiments the discharge head 118 of the spray applicator 116 is positioned at about a 25 degree angle relative to the elongated arm 109. Additionally, a size and shape of the spray field 101 discharged from the spray applicator 116 is collectively based on a distance between the discharge head 118 of the spray applicator 116 and the rotatable disc 112. It should be understood that a larger spray pattern may be formed by increasing a vertical distance and/or height between the spray applicator 116 and the rotatable disc 112 while a relatively smaller spray pattern may be formed by decreasing a vertical distance therebetween.

In particular, the rotatable disc 112 is positioned relative to the spray applicator 116 such that at least a portion of the spray field 101 of the discharge head 118, and more specifically an overspray portion 101', intersects with the interior surface 115 of the rotatable disc 112. In other words, the interior surface 115 of the rotatable disc 112 is at least partially positioned within the spray field 101 such that the interior surface 115 receives at least a portion of the material discharged from the spray applicator 116 (i.e. the overspray portion 101') at step 206. Accordingly, a size and shape of the overspray portion 101' captured by the interior surface 115, and/or a size and shape of the resulting spray field 101 not captured by the interior surface 115, is indicative of a distance and orientation of the discharge head 118 relative to the rotatable disc 112. With the overspray portion 101' of the spray field 101 received by the interior surface 115 of the rotatable disc 112, a uniform spray pattern is generated by the spray apparatus 100 from the resulting spray field 101 discharged by the spray applicator 116. In other words, at step 208, the spray field 101 is cut by the rotatable disc 112 by receiving the overspray portion 101' therein to thereby generate a spray pattern from the resulting spray field 101 that includes a consistent profile (i.e. thickness, shape, size, and/or the like).

Still referring to FIG. 4, it should therefore be understood that the rotatable disc 112 is configured to generate a first spray pattern from the spray applicator 116 in response to increasing a vertical distance between a height of the spray applicator 116 and a position of the rotatable disc 112. Additionally and/or alternatively, the rotatable disc 112 is configured to generate a second spray pattern from the spray applicator 116 that is different than the first spray pattern in response to decreasing a vertical distance between a height of the spray applicator 116 and a position of the rotatable disc 112. In this instance, the spray field 101 of the first spray pattern may be greater than the second spray pattern. It should be understood that the spray apparatus 100 is configured to generate a plurality of spray patterns based on a position and/or orientation of the spray applicator 116 relative to the rotatable disc 112. With the interior surface 115 of the rotatable disc 112 rotating in response to activation of the motor 114, varying regions of the interior surface 115 momentarily aligns with the spray field 101 as the spray applicator 116 discharges material therefrom. In this instance, varying regions of the interior surface 115 receive the overspray portion 101' thereon.

Referring to FIGS. 3-4, with the scraper device 120 positioned in fixed engagement with the rotatable disc 112 along the interior surface 115, the scraper device 120 is configured to remove material accumulated thereon from the overspray portion 101' of the spray field 101. In particular, at step 210, at least the angled wall 122 and the upper horizontal wall 126 of the scraper device 120 (i.e. collectively defining the abutment end 122, 126 of the scraper device 120) continuously engages the interior surface 115 as the rotatable disc 112 rotates. With the body 121 of the scraper device 120 being flexibly deformable and the abutment end 122, 126 being in continuous contact with the interior surface 115, the scraper device 120 is configured to extract accumulated material from the overspray portion 101' of the spray field 101 off of the interior surface 115 as the rotatable disc 112 rotates. At step 212, the scraper device 120 transfers material extracted from the interior surface 115 via the abutment end 122, 126 to the vertical wall 124 and/or the lower horizontal wall 128 along the body 121. The material is transferred thereon until released from the body 121 and received in the material manifold 130 positioned below the scraper device 120.

Referring back to FIG. 3, due to a continued rotation of the rotatable disc 112 the scraper device 120 is configured to remove accumulated material received by the varying regions of the interior surface 115 in response to the fixed and continuous engagement of the abutment end 122, 126 with the rotatable disc 112. In some embodiments, the body 121 of the scraper device 120 flexibly deforms in response to contacting the accumulated material along the varying regions of the interior surface 115 dependent on a volume and/or thickness of the material received thereon. Accordingly, material received along the interior surface 115 is continuously removed by the scraper device 120 to ensure excessive volumes of material are not accumulated on the rotatable disc 112 during use of the spray apparatus 100. By constantly cleaning the interior surface 115 of the rotatable disc 112 with the scraper device 120 a capability of the spray apparatus 100 to effectively generating a uniform spray pattern along the target object may be maintained. Furthermore, the extracted material is collected in the material manifold 130 and preserved for subsequent use by an operator of the spray apparatus 100 thereby minimizing instances of material waste during use of the spray apparatus 100.

It should now be understood that spray apparatuses according to the present disclosure include rotatable discs and spray applicators that are collectively configured to form a uniform spray pattern received along a target object. In embodiments, a spray apparatus includes a stand, a motor and a spray applicator secured thereto, and a rotatable disc secured to the stand relatively above the spray applicator. With the rotatable disc secured to the stand relatively above the spray applicator, the rotatable disc is positioned within a spray field of the spray applicator. The rotatable disc is coupled to the motor such that the rotatable disc is configured to rotate in response to activation of the motor. The rotatable disc is configured to receive an overspray from the spray applicator to generate a spray pattern from the spray applicator. The spray apparatus further includes a scraper positioned in fixed engagement with the rotatable disc such that the scraper is configured to remove accumulated overspray from the rotatable disc.

It is noted that the terms "substantially" and "partially" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A spray apparatus, comprising:

a stand;

a motor secured to the stand;

an elongated arm secured to the stand and extending horizontally;

a spray applicator coupled to the elongated arm, horizontally pivotable about the elongated arm, and horizontally movable along the elongated arm;

a rotatable disc secured to the stand relatively above the spray applicator such that the rotatable disc is positioned within a spray field of the spray applicator, wherein the rotatable disc is coupled to the motor such that the rotatable disc is configured to rotate in response to activation of the motor, wherein the rotatable disc is configured to receive an overspray of the spray field to generate a spray pattern from the spray applicator, wherein the spray applicator is horizontally movable with respect to the rotatable disc; and a scraper positioned in fixed engagement with the rotatable disc, wherein the scraper is configured to remove accumulated overspray from the rotatable disc.

2. The spray apparatus of claim 1, wherein the rotatable disc is configured to receive the overspray along an interior surface of the rotatable disc that is positioned in at least partial alignment with the spray field of the spray applicator.

3. The spray apparatus of claim 2, wherein the scraper is positioned along the interior surface of the rotatable disc such that the scraper is in fixed engagement with the rotatable disc.

4. The spray apparatus of claim 3, wherein the scraper includes one or more walls forming an abutment end that is flexibly deformable and in continuous contact with the interior surface as the rotatable disc rotates.

5. The spray apparatus of claim 4, wherein the abutment end of the scraper is configured to extract accumulated overspray from the interior surface of the rotatable disc and transfer the overspray to a manifold.

6. The spray apparatus of claim 1, further comprising at least two modular legs secured to the stand such that a height of the spray applicator relative to the rotatable disc is selectively adjustable, wherein the elongated arm extends between the at least two modular legs.

7. The spray apparatus of claim 6, wherein the rotatable disc is configured to generate a first spray pattern of the spray applicator in response to increasing a vertical distance between the spray applicator and the rotatable disc.

8. The spray apparatus of claim 7, wherein the rotatable disc is configured to generate a second spray pattern of the spray applicator in response to decreasing the vertical distance between the spray applicator and the rotatable disc.

9. The spray apparatus of claim 8, wherein the spray field of the first spray pattern is greater than the second spray pattern.

10. The spray apparatus of claim 1, comprising:

a plurality of elongated arms secured to the stand and extending horizontally;

a plurality of spray applicators each coupled to a respective elongated arm, horizontally pivotable about the respective elongated arm, and horizontally movable along the respective elongated arm; and a plurality of rotatable discs each secured to the stand above a respective spray applicator, wherein the respective spray applicator is horizontally movable with respect to a respective rotatable disc.

11. The spray apparatus of claim 10, further comprising a control valve secured to the stand and coupled to the pneumatic rotary actuator, wherein the control valve is configured to adjust rotational speed of the rotatable disc.

12. The spray apparatus of claim 1, further comprising an actuator fluidly coupled to the spray applicator and configured to dispense material from a discharge head of the spray applicator in response to actuation of the actuator.

13. A pneumatic painting assembly, comprising:

a modular stand that is configured to selectively translate;

a pneumatic motor secured to the modular stand such that a position of the pneumatic motor is selectively adjustable on the modular stand;

an elongated arm secured to the modular stand and extending horizontally;

a spray applicator coupled to the elongated arm, horizontally pivotable about the elongated arm such that an angular position of the spray applicator is selectively adjustable on the modular stand, and horizontally movable along the elongated arm;

a disc secured to the modular stand relatively above the spray applicator such that the disc is partially positioned within a spray field of the spray applicator, wherein the disc is coupled to the pneumatic motor such that the disc is configured to rotate in response to activation of the pneumatic motor, wherein the spray applicator is horizontally movable with respect to the rotatable disc; and a scraper positioned in continuous engagement with the rotatable disc;

wherein the disc is configured to catch a portion of material received on the disc from the spray applicator to generate a spray pattern of the spray applicator, and the scraper is configured to remove material caught by the rotatable disc from the spray applicator.

14. The pneumatic painting assembly of claim 13, wherein an interior surface of the disc is positioned within the spray field of the spray applicator such that the interior surface receives at least a portion of material discharged from the spray applicator.

15. The pneumatic painting assembly of claim 14, wherein the interior surface of the disc rotates in response to activation of the motor such that varying regions of the interior surface catch material discharged from the spray applicator.

16. The pneumatic painting assembly of claim 15, wherein the disc is configured to transfer material caught by the varying regions of the interior surface to the scraper positioned in continuous engagement thereon.

* * * * *